United States Patent [19]

Hooper

[11] Patent Number: 4,985,968

[45] Date of Patent: Jan. 22, 1991

[54] FASTENER MEANS FOR PACIFIERS, TOYS, BADGES AND LIKE ARTICLES

[76] Inventor: Fred V. Hooper, 540 Isley Pl., Burlington, N.C. 27215

[21] Appl. No.: 415,071

[22] Filed: Sep. 29, 1989

[51] Int. Cl.[5] ..... A44B 21/00

[52] U.S. Cl. ..... 24/302; 24/3 M; 24/662

[58] Field of Search ..... 24/301, 302, 3 M, 662, 24/94, 90 A, 108, 113 R, 460, 461, 462, 297, 324

[56] References Cited

U.S. PATENT DOCUMENTS

| | | | |
|---|---|---|---|
| 1,270,494 | 6/1918 | Christiansen | 24/302 |
| 1,467,280 | 9/1923 | Warner | 24/94 |
| 1,828,041 | 10/1931 | Hamacher . | |
| 2,041,498 | 5/1936 | Swidersky | 24/222 |
| 2,089,221 | 8/1937 | Patur et al. | 24/5 |
| 2,121,147 | 6/1938 | Goodrich | 24/263 |
| 2,472,235 | 8/1944 | Sullivan | 24/245 |
| 2,683,908 | 7/1954 | Carpinella | 24/108 |
| 3,392,729 | 7/1968 | Lenoir | 24/462 |
| 3,551,963 | 1/1971 | Mosher, Jr. et al. | 24/662 |
| 4,308,647 | 1/1982 | Gillis | 24/245 |
| 4,356,601 | 11/1982 | Kimura | 24/297 |
| 4,559,675 | 12/1985 | Devenny | 24/460 |
| 4,765,037 | 8/1988 | Perry | 24/301 |

OTHER PUBLICATIONS

Photograph of actual product sold by Baby Needs, Inc. since Oct. 31, 1989.

*Primary Examiner*—Victor N. Sakran
*Attorney, Agent, or Firm*—Rhodes, Coats & Bennett

[57] ABSTRACT

A decorative body member includes a safe and harmless separable, interlocking fastening device for engaging a portion of a garment therebetween. In one embodiment, an elongated ribbon is attached at one end to the body member and at the other to a pacifier, teething ring, or toy, to avoid loss. The fastener includes a circular pattern of fingers or prongs (female element) extending from the rear surface of the body member. The male element is a disk which is received within the fingers with the fabric therebetween. The disk is sufficiently large to prevent swallowing, and preferably includes an aperture through the center thereof to provide for passage of air if the disk should become lodged in the mouth or inadvertently swallowed.

11 Claims, 1 Drawing Sheet

P
10
30

15
60
35
42
42
10
F
40
25
62
62
20

52
50
54
20
51
56

20'
56'
54'

42a
51
50
42b
F
42c
15

FASTENER MEANS FOR PACIFIERS, TOYS, BADGES AND LIKE ARTICLES

BACKGROUND AND SUMMARY OF THE PRESENT INVENTION

The present invention is directed to the provision of a safe, and also decorative, means for attaching a pacifier, teething ring, rattle, badge, button or other such accessory to a garment to avoid loss. One such device is disclosed in U.S. Pat. No. 4,765,037 and is in the form of a strap having a loop to hold the pacifier at one end and a hinged clip at the other end. The hinged clip is attached to an appropriate area of the child's clothing. The hinged clip is an attractive nuisance to the child in that the infant may play with the clip and become injured.

Another approach has been to pin a long ribbon to the clothing, looping the pacifier on the end opposite the pin. However, one major disadvantage to this and other such approaches is the danger of the child being stabbed by an unfastened pin, or perhaps swallowing a pin or clip. A further complaint is the general unattractiveness of such fasteners. While such complaints may be dispelled by securing the safety pin to the rear of a decorative body. The danger from the pin still exists.

Even for adult garments, a badge connected to a garment of high quality fabric by a safety pin or another conventional clip may be both unsightly and damaging to the fabric. Therefore, the present invention is applicable to adult garments as well as to infants' clothing. However, for the purpose of explanation, the invention will for the most part be described with respect to the attachment of a pacifier to an infant's clothing.

The present invention is directed to the attachment of badges to garments while overcoming most of the dangers related to prior known devices and to providing a pacifier attachment means that is a decorative and safe accessory for infants and very young children. Broadly described, the device is a fastener having separable interlocking male and female parts that, when engaged, grip and retain a portion of the child's garment sandwiched therebetween. The fastener of the present invention is not sharp and cannot be swallowed. An elongated ribbon is attached to the fastening device as a tether for the pacifier. In a preferred embodiment, one end of the ribbon is attached to the fastener by a conventional snap and thus may be removed for cleaning. The opposite end of the ribbon is formed into a retaining loop by means of a second snap.

To reduce the risk of serious injury to a child and damage to fabric, the invention does not include any pins or other sharp items which might injure the child. Additionally, the separable male and female elements are enlarged to the extent that an infant or small child will not be able to swallow the device. The male element includes a plug or disk member and an enlarged annular flange surrounding the plug. The plug member is inserted into the female member and retained much in the way a snap fastener works. The enlarged flange increases the diameter of the male element and the resulting piece is generally of a size that would be difficult for an infant or young child to swallow. As a further injury prevention means, the plug member in the preferred embodiment includes an aperture through the center thereof such that, if the element becomes lodged in the mouth, air can still pass through and the child's breathing is unimpaired until the object is removed.

The outer face of the fastener is of a decorative nature and may be in the shape of animal figures, dolls, or the like and have colorful indicia thereon. The fastener preferably is formed from a very hard, rigid and highly durable polymer. It should have smooth surfaces and must be completely non-toxic. A better understanding will be had by a study of the following detailed description in conjunction with the accompanying drawings.

DETAILED DESCRIPTION OF A PREFERRED EMBODIMENT

Figures 1, 2, 3, 4, 5:
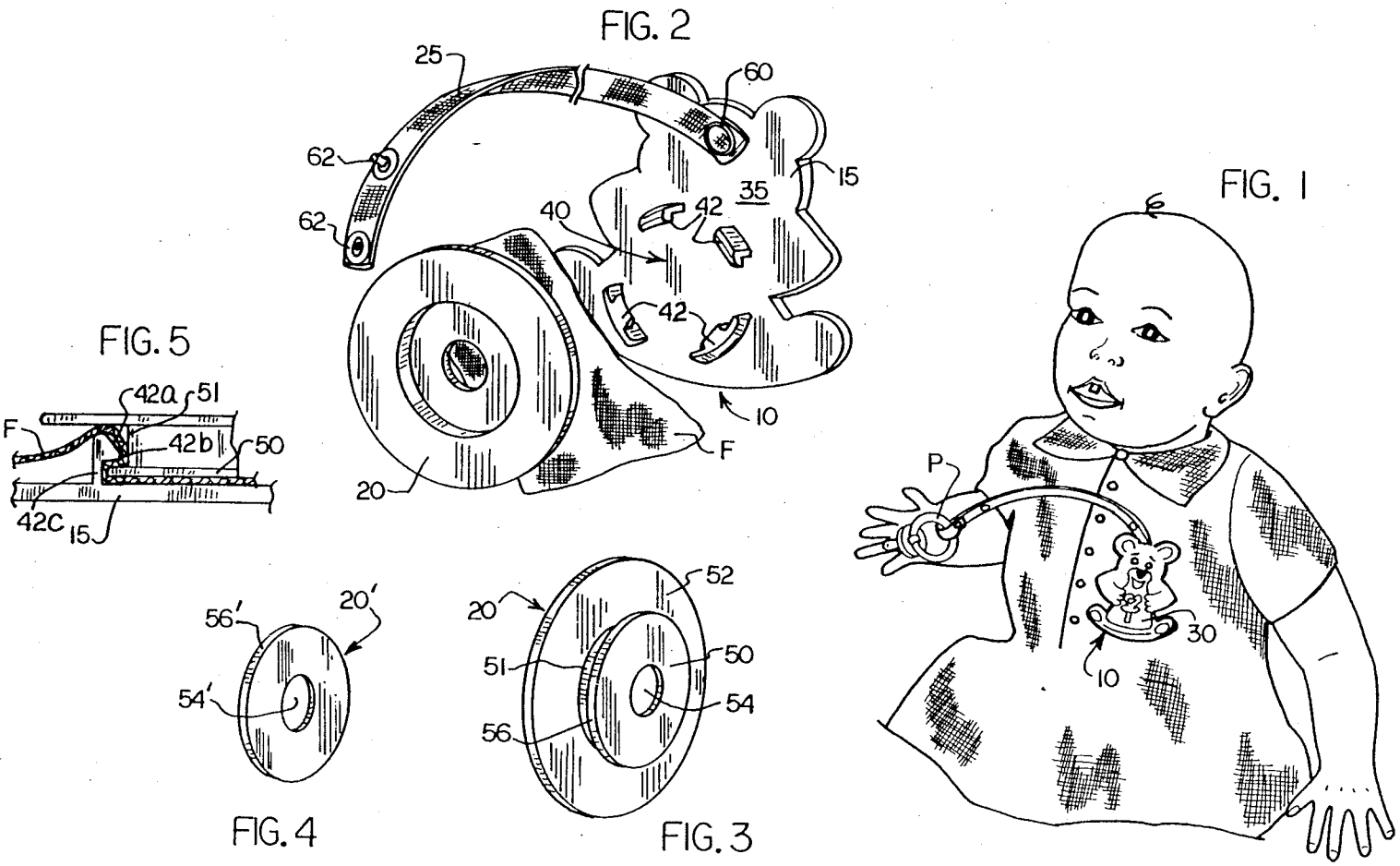
FIG. 1 is a perspective view of a preferred embodiment as attached to an infant's clothing.
FIG. 2 is an exploded perspective view of the device of FIG. 1.
FIG. 3 is a perspective view of the preferred embodiment of the male element of the present invention.
FIG. 4 is an alternate embodiment of the male element.
FIG. 5 is a detailed cross section of the interlocking prongs and disk.

Looking first at FIG. 1, the fastening device 10 is shown in place on the infant's clothing and having a pacifier P attached or tethered thereto. The infant's clothing, either shirt, dress or the like, is clasped between the male and female elements of fastener 10 in a sandwich-like fashion. While the present description speaks of attaching a pacifier thereto, it is obvious that other infant toys or accessories could be attached to the fastening device. Further, the device 10 is designed to be compatible with placement on any area to the infant's clothing that is functionally desirable, with the advantage of being a decorative accessory.

The details of the fastening device 10 are best seen in FIG. 2, which illustrates the female element 15, the male element 20, and the ribbon-type pacifier attachment or tether means 25. The female element 15 generally is comprised of a decorative outer face 30, an inner face 35, and receiving or locking means 40 for receiving and holding the male element 20. In the preferred embodiment, the locking means 40 is comprised of a plurality of resilient or flexible prongs 42 arranged generally in a circular pattern, extending outwardly from the inner face 35 of element 15. The inner diameter of the circular arrangement of prongs is substantially equivalent to the outer diameter of the male plug member described below. While the pattern of prongs 42 is illustrated as being preferred, it is not critical as the pattern may be elliptical, rectangular, or even an irregular polygon.

As illustrated in FIG. 5, each prong 42 includes a ramp section **42*a* and a lip 42*b*. The prongs are so arranged and spaced that the diameter of the circular pattern formed by the lips 42*b* is less than the diameter of the disk 50. Therefore, when the disk 50 is initially positioned with respect to the prongs, the edge of the disk 50 engages the ramp sections 42*a*. As the disk 50 is inserted into the pattern of prongs 42 with the fabric F therebetween, the ramp sections 42*a* of each prong 42 allow the disk 50 to be urged downwardly spreading the fingers causing the leg 42*c* of each prong 42 to bend outwardly. When the disk and the underlying fabric F have moved past the lip 42*b*, the prongs 42 spring back to the original position with the lip 42*b* locked over the edge of disk 50. Since the attachment disk is beneath the child's garment, the infant does not have access to the disk 50** and is not tempted to attempt the removal thereof.

The male element 20 preferably includes a locking disk 50 which is inserted between the gripping prongs 42 and a flange member 52 surrounds the disk to substantially decrease the likelihood that the infant can swallow the element. The disk 50 is separated from the flange 52 by a separating wall 51 into which the fabric F and prong lip 42*b* extend. In the alternate embodiment of FIG. 4, the male element 20 has no flange 52, is smaller in overall diameter, and could inadvertently be swallowed by infants. However, in embodiments where the device is utilized or designed for older children or on the underside of the child's garment, the risk of injury may be less substantial, and the reduced size acceptable.

Returning to the enlarged element 20 of the preferred embodiment, the disk 50 includes another injury prevention means in the form of the centrally disposed aperture 54. If the element should be lodged in the mouth or swallowed in any event, the aperture 54 allows for passage of air therethrough and breathing until the object is removed from the mouth or throat. The size of the aperture should be large enough for air to be breathed therethrough. In the preferred embodiment, the aperture is approximately three-eighths or an inch in diameter.

With regard to the more aesthetic features of the invention, at least the outer face of the female element includes a decorative figure or the like thereon. In the embodiment shown, the female element is formed into the shape of a teddy bear but may be any prescribed animal, doll, character, etc. with coloring and other indicia completing the design.

The pacifier tether 25 is preferably a decorative ribbon having a snap fastener 60 on one end to attach the ribbon to the fastener and another snap 62 on the opposite end to form a loop to secure the ribbon to the pacifier handle in a conventional manner.

It should also be understood that while the above description is related to baby accessories, the fastener can easily be modified for use as a badge or badge holder for adult use.

While other modifications may become apparent to those skilled in the art, the invention is limited only by the claims below.

What is claimed is:

1. A fastening means for attaching a decorative button, teething ring, pacifier or other item to clothing, including:

(a) a female element comprising a body member having inner and outer faces, a plurality of prongs extending away from said inner face, said prongs having a lip means and being spaced apart substantially and arranged in a closed pattern; said prongs being somewhat flexible for releasably gripping a mating element therein;

(b) a male element including a locking disk member for releasable engagement beneath said lip means of said prongs with a portion of the item of clothing therebetween, said disk having an outer configuration slightly greater than the corresponding dimension between said closed pattern of prongs wherein said locking disk further includes an annular flange surrounding said disk and having an enlarged diameter, said flange being of such a size and configuration as to the prevent swallowing by a small child; and (c) said prongs and said locking disk member forming a locking means for gripping a portion of the clothing therebetween and preventing inadvertent dislodgement of said female member therefrom.

2. A fastening device according to claim 1 wherein said locking means further includes:

(a) each of said prongs having a ramp section terminating in an edge, said ramp section flexibly attached to the inner surface of said body member by a leg means;

(b) said prongs having sufficient flexibility to permit an outward flexing when said disk member is forced therebetween;

(c) said disk thus being frictionally and releasably gripped beneath said edge of said prongs with the garment sandwiched therebetween.

3. A fastening device according to claim 2 wherein said locking means further includes:

(a) a lip extending outwardly beneath said ramp section of each prong, said lip having a lower surface extending horizontally outwardly away from said leg;

(b) said disk member including lip engagement means for releasably interlocking with said lips to retain said disk member in said prongs.

4. A fastening device according to claim 3 wherein said lip engagement means of said disk includes the outer edge thereof which extends beneath said lower horizontal surface of said lips to prevent said plug from slipping away from said prongs.

5. The fastening device according to claim 1 and further including a tether means attached to said female element for removably attaching a pacifier or infant's toy thereto.

6. The fastening device according to claim 5 wherein said annular flange is separated from said disk by a wall.

7. A fastening device according to claim 5 wherein said tether means is comprised of a length of ribbon having means on one end thereof for attachment to a pacifier or other article, and the opposite end attached to said body member.

8. A fastening device according to claim 1 and further comprising an injury prevention means including an aperture extending through said male element for providing an air passageway therethrough in the event the male element is inadvertently swallowed or lodged in the mouth.

9. A fastening device according to claim 1 wherein said female element further includes a decorative indicia of a selected characteristic on said outer face.

10. A fastening device according to claim 9 wherein said decorative indicia is comprised of said body member having an outer configuration in the form of a selected decorative figure.

11. A fastening means for attaching a decorative button, teething ring, pacifier or other item to clothing, including:

(a) a female element comprising a body member having inner and outer faces, a plurality of prongs extending outwardly from said inner face, said prongs being arranged in a closed pattern; said prongs having a lip means and being spaced apart substantially arranged in a closed pattern; said prongs being somewhat flexible for releasably gripping a mating element therein;

(b) a male element including a locking disk member for releasable engagement beneath said lip means of said prongs, with a portion of the item of clothing therebetween, said disk having an outer configuration slightly greater than the corresponding dimension between said closed pattern of prongs; said male element having an aperture extending through it to provide an air passageway in the the event the male element is inadvertently swallowed or lodged in the mouth; and (c) said prongs and said locking disk member forming a locking means for gripping a portion of the clothing therebetween and preventing inadvertent dislodgement of said female member therefrom.

* * * * *